US009561938B2

(12) United States Patent
Kilpeläinen

(10) Patent No.: US 9,561,938 B2
(45) Date of Patent: Feb. 7, 2017

(54) METHOD AND AN ARRANGEMENT FOR AUTOMATIC ELEVATOR INSTALLATION

(71) Applicant: KONE Corporation, Helsinki (FI)

(72) Inventor: Pekka Kilpeläinen, Oulu (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/092,248

(22) Filed: Apr. 6, 2016

(65) Prior Publication Data

US 2016/0311657 A1 Oct. 27, 2016

(30) Foreign Application Priority Data

Apr. 23, 2015 (EP) ..... 15164766

(51) Int. Cl.
*B66B 19/00* (2006.01)
*B66B 19/06* (2006.01)

(52) U.S. Cl.
CPC ..... *B66B 19/00* (2013.01); *B66B 19/002* (2013.01); *B66B 19/06* (2013.01)

(58) Field of Classification Search
CPC ..... B66B 19/00; B66B 19/06; B66B 19/002
See application file for complete search history.

(56) References Cited

U.S. PATENT DOCUMENTS 5,931,264 A * 8/1999 Gillingham ..... B66B 7/1246 104/127
7,886,454 B2 * 2/2011 Barneman ..... B66B 19/002 33/562
2009/0120734 A1 * 5/2009 Barneman ..... B66B 19/002 187/408
2010/0163349 A1 7/2010 Barneman et al.
2012/0118219 A1 * 5/2012 Lindberg ..... B66B 19/00 116/201

(Continued)

FOREIGN PATENT DOCUMENTS

GB 2 260 963 A 5/1993
JP 9-221288 A 8/1997

(Continued)

*Primary Examiner* — Rodney Mintz
(74) *Attorney, Agent, or Firm* — Birch, Stewart, Kolasch & Birch, LLP

(57) ABSTRACT

A method and arrangement for automatic elevator installation includes marking each door opening in the elevator shaft with door reflectors, and creating a reference coordinate system of the elevator shaft with a robotic total station positioned at a bottom of the elevator shaft, measuring the position of the door reflectors with the robotic total station, fitting straight door lines to the measurements in order to form virtual plumb lines for the doors in the elevator shaft, marking predetermined guide rail positions on the bottom of the elevator shaft and installing lowermost guide rails manually to the shaft based on the guide rail positions, forming vertical guide rail lines, i.e. virtual plumb lines for the guide rails with the robotic total station based on the door lines, providing an upwards and downwards movable installation platform in the elevator shaft provided with platform reflectors, and measuring the position of the platform reflectors with the robotic total station, whereby the orientation and the position of the installation platform in relation to the elevator shaft can be determined.

15 Claims, 8 Drawing Sheets

(56) References Cited

U.S. PATENT DOCUMENTS

| | | | | |
|---|---|---|---|---|
| 2015/0217972 | A1* | 8/2015 | Hawkins | G01C 15/10 187/391 |
| 2015/0360913 | A1* | 12/2015 | Fernandez | B66B 7/1246 187/408 |
| 2016/0068369 | A1* | 3/2016 | Valkama | B66B 5/0087 33/645 |

FOREIGN PATENT DOCUMENTS

| | | | |
|---|---|---|---|
| WO | WO 2007/135228 | A1 | 11/2007 |
| WO | WO 2014/053184 | A1 | 4/2014 |

* cited by examiner

METHOD AND AN ARRANGEMENT FOR AUTOMATIC ELEVATOR INSTALLATION

FIELD OF THE INVENTION

The invention relates to a method and an arrangement for automatic elevator installation.

BACKGROUND ART

An elevator comprises an elevator car, lifting machinery, ropes, and a counterweight. The elevator car is supported on a transport frame being formed by a sling or a car frame. The sling surrounds the elevator car. The lifting machinery moves the car upwards and downwards in a vertically extending elevator shaft. The sling and thereby also the elevator car are carried by the ropes, which connect the elevator car to the counterweight. The sling is further supported with gliding means at guide rails extending in the vertical direction in the elevator shaft. The gliding means can comprise rolls rolling on the guide rails or gliding shoes gliding on the guide rails when the elevator car is mowing upwards and downwards in the elevator shaft. The guide rails are supported with fastening means on the side wall structures of the elevator shaft. The gliding means engaging with the guide rails keep the elevator car in position in the horizontal plane when the elevator car moves upwards and downwards in the elevator shaft. The counterweight is supported in a corresponding way on guide rails supported with fastening means on the wall structure of the elevator shaft. The elevator car transports people and/or goods between the landings in the building. The elevator shaft can be formed so that one or several of the side walls are formed of solid walls and/or so that one or several of the side walls are formed of an open steel structure.

The guide rails are formed of guide rail elements of a certain length. The guide rail elements are connected in the installation phase end-on-end one after the other in the elevator shaft. The guide rails are attached to the walls of the elevator shaft with fastening means at fastening points along the height of the guide rails.

WO publication 2007/135228 discloses a method for installing the guide rails of an elevator. In the first phase a first pair of opposite car guide rail elements is installed starting from the bottom of the elevator shaft. In the second phase a second pair of opposite car guide rails is installed end-on-end with the first pair of opposite car guide rails. The process is continued until all the pairs of opposite car guide rails have been installed. The counterweight guide rails are installed in a corresponding manner. A laser transmitter is used in connection with each guide rail to align the guide rail in the vertical direction. A self-directional laser could be used, which automatically directs the laser beam vertically upwards. The laser transmitters are first positioned at the bottom of the elevator shaft when the lowermost section of guide rails is installed. An alignment appliance provided with an alignment element is supported on each guide rail at each position where the alignment of the guide rail is to be done. The laser beam hits the alignment element, whereby the guide rail can be aligned so that the hitting point of the laser beam is in the middle of the alignment element. The laser transmitters are moved stepwise upwards for alignment of the next section of guide rails.

WO publication 2014/053184 discloses a guide rail straightness measuring system for elevator installations. The measuring system comprises at least one plumb line mounted vertically in the elevator shaft adjacent to the guide rail and at least one sensor arrangement to be mounted on a carrier to travel vertically along the guide rail. The sensor arrangement comprises a frame, at least one guide shoe connected to the frame for sliding or rolling along the guide surface of the guide rail, a bias means for placing and biasing the frame against the guide surface, and at least one sensor means for sensing the position of the plumb line with respect to the frame.

BRIEF DESCRIPTION OF THE INVENTION

An object of the present invention is to present a novel method for automatic elevator installation.

The method for automatic elevator installation comprises the steps of:

marking each door opening in the elevator shaft with downwards facing door reflectors positioned at opposite sides of the door opening, positioning a robotic total station at a bottom of the elevator shaft and creating a reference coordinate system of the elevator shaft with the robotic total station, measuring the position of the door reflectors in relation to the elevator shaft with the robotic total station, fitting straight door lines to the measurements, said straight door lines forming virtual plumb lines for the doors in the elevator shaft, marking the predetermined positions of the guide rails on the bottom of the elevator shaft based on the dimensions of the elevator shaft and the elevator car, installing the lowermost guide rails manually to the elevator shaft based on the predetermined positions of the guide rails, forming vertical guide rail lines with the robotic total station based on the door lines, said vertical guide rail lines forming virtual plumb lines for the guide rails in the elevator shaft, providing an upwards and downwards along the car guide rails movable installation platform in the elevator shaft, positioning downwards facing platform reflectors on a bottom of the installation platform, measuring the position of the platform reflectors in relation to the elevator shaft with the robotic total station, whereby the orientation and the position of the installation platform in relation to the elevator shaft can be determined.

The arrangement for automatic elevator installation is characterised in that:

each door opening in the elevator shaft is marked with downwards facing door reflectors positioned at opposite sides of the door opening, a robotic total station is positioned at a bottom of the elevator shaft, whereby a reference coordinate system of the elevator shaft is created with the robotic total station, the position of the door reflectors in relation to the elevator shaft (20) is measured with the robotic total station, straight door lines are fitted to the measurements, said straight door lines forming virtual plumb lines for the doors in the elevator shaft, the predetermined positions of the guide rails on the bottom of the elevator shaft are marked based on the dimensions of the elevator shaft and the elevator car, the lowermost guide rails are installed manually to the elevator shaft based on the predetermined positions of the guide rails, vertical guide rail lines are formed with the robotic total station based on the door lines, said vertical guide rail lines forming virtual plumb lines for the guide rails in the elevator shaft, an upwards and downwards along the car guide rails movable installation platform is provided in the elevator shaft, downwards facing platform reflectors are positioned on a bottom of the installation platform, the position of the platform reflectors is measured in relation to the elevator shaft with the robotic total station, whereby the orientation and the position of the installation platform in relation to the elevator shaft can be determined.

BRIEF DESCRIPTION OF THE DRAWINGS

The invention will in the following be described in greater detail by means of preferred embodiments with reference to the attached drawings, in which.

DETAILED DESCRIPTION OF EMBODIMENTS OF THE INVENTION

Figure 1:
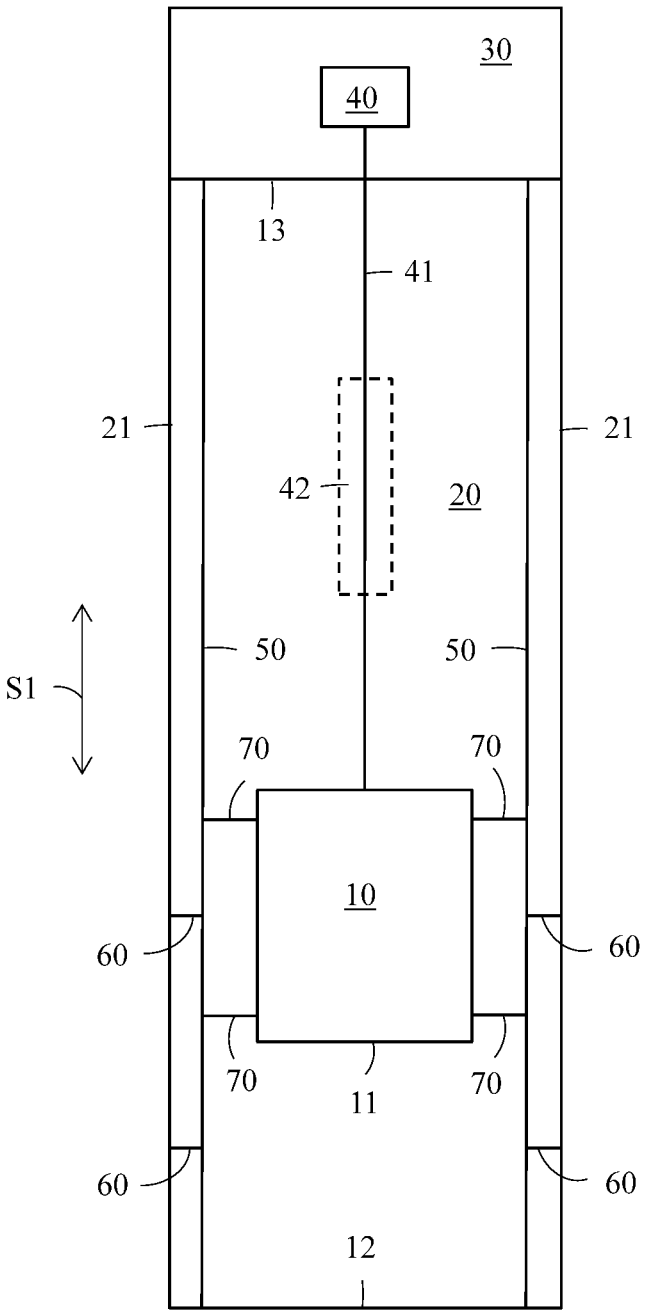
FIG. 1 shows a vertical cross section of an elevator.
Figure 2:
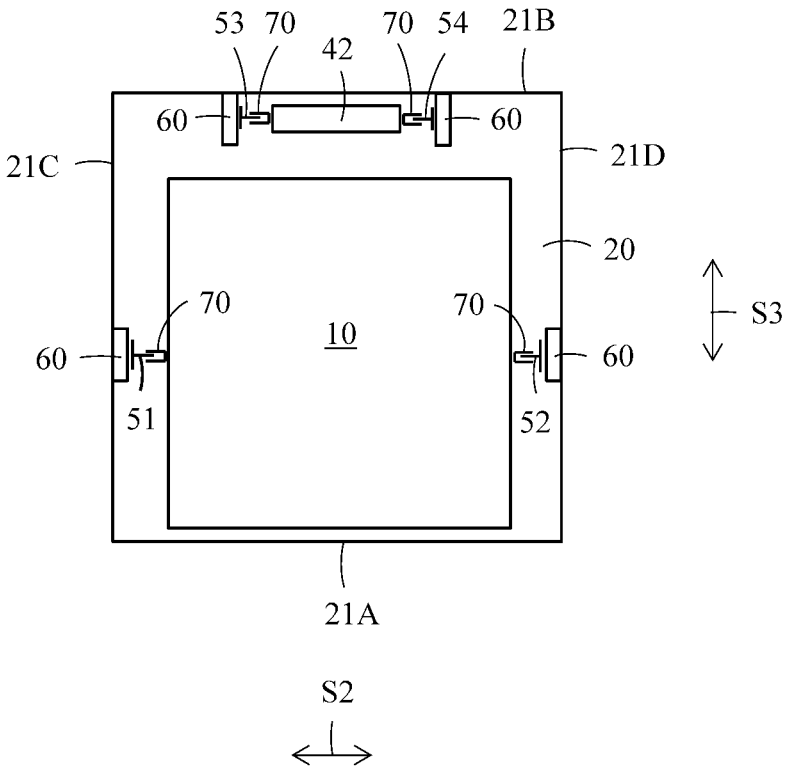
FIG. 2 shows a horizontal cross section of the elevator.

FIG. 1 shows a vertical cross section and FIG. 2 shows a horizontal cross section of an elevator.

The elevator comprises a car 10, an elevator shaft 20, a machine room 30, lifting machinery 40, ropes 41, and a counter weight 42. The car 10 may be supported on a transport frame 11 or a sling surrounding the car 10. The lifting machinery 40 moves the car 10 in a first direction S1 upwards and downwards in a vertically extending elevator shaft 20. The sling 11 and thereby also the elevator car 10 are carried by the ropes 41, which connect the elevator car 10 to the counter weight 42. The sling 11 and thereby also the elevator car 10 is further supported with gliding means 70 at guide rails 50 extending in the vertical direction in the elevator shaft 20. The elevator shaft 20 has a bottom 12, a top 13, a front wall 21A, a back wall 21B, a first side wall 21C and a second opposite side wall 21D. There are two car guide rails 51, 52 positioned on opposite side walls 21C, 21D of the elevator shaft 20. The gliding means 70 can comprise rolls rolling on the guide rails 50 or gliding shoes gliding on the guide rails 50 when the elevator car 10 is mowing upwards and downwards in the elevator shaft 20. There are further two counter weight guide rails 53, 54 positioned at the back wall 21B of the elevator shaft 20. The counter weight 42 is supported with corresponding gliding means 70 on the counter weight guide rails 53, 54. The landing doors (not shown in the figure) are positioned in connection with the front wall 21A of the elevator shaft 20.

Each car guide rail 51, 52 is fastened with fastening means 60 at the respective side wall 21C, 21D of the elevator shaft 20 along the height of the car guide rail 51, 52. Each counter weight guide rail 53, 54 is fastened with corresponding fastening means 60 at the back wall 21B of the elevator shaft 20 along the height of the counter weight guide rail 53, 54. The figure shows only two fastening means 60, but there are several fastening means 60 along the height of each guide rail 50. The cross section of the guide rails 50 can have the form of a letter T. The vertical branch of the guide rail element 50 forms three gliding surfaces for the gliding means 70 comprising rolls or gliding shoes. There are thus two opposite side gliding surfaces and one front gliding surface in the guide rail 50. The cross-section of the gliding means 70 can have the form of a letter U so that the inner surface of the gliding means 70 sets against the three gliding surfaces of the guide rail 50. The gliding means 70 are attached to the sling 11 and/or to the counter weight 42.

The gliding means 70 engage with the guide rails 50 and keep the elevator car 10 and/or the counter weight 42 in position in the horizontal plane when the elevator car 10 and/or the counter weight 42 moves upwards and downwards in the first direction S1 in the elevator shaft 20. The elevator car 10 transports people and/or goods between the landings in the building. The elevator shaft 20 can be formed so that all side walls 21, 21A, 21B, 21C, 21D are formed of solid walls or so that one or several of the side walls 21, 21A, 21B, 21C, 21D are formed of an open steel structure.

The guide rails 50 extend vertically along the height of the elevator shaft 20. The guide rails 50 are thus formed of guide rail elements of a certain length e.g. 5 m. The guide rail elements 50 are installed end-on-end one after the other.

FIG. 1 shows a first direction S1, which is a vertical direction in the elevator shaft 20. FIG. 2 shows a second direction S2, which is the direction between the first side wall 21C and the second side wall 21D in the elevator shaft 20 i.e. the direction between the guide rails (DBG). FIG. 2 shows further a third direction S3, which is the direction between the back wall 21B and the front wall 21A in the elevator shaft 20 i.e. the back to front direction (BTF). The second direction S2 is perpendicular to the third direction S3. The second direction S2 and the third direction S3 form a coordinate system in a horizontal plane in the elevator shaft 20.

Figure 3:
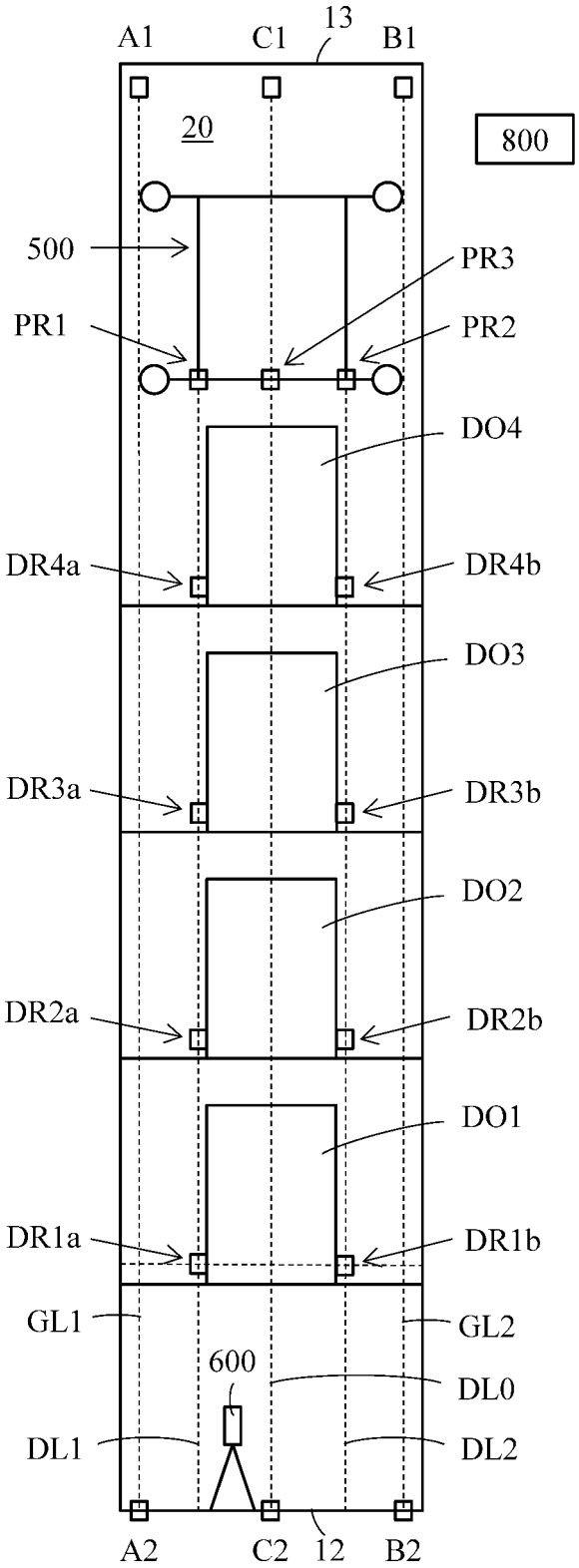
FIG. 3 shows a vertical cross section of an elevator shaft showing the principle of the invention.

FIG. 3 shows a vertical cross section of an elevator shaft showing the principle of the invention. The idea is as a first step to measure the dimensions of the empty elevator shaft 20 with a robotic total station 600. Different positions in the empty elevator shaft are marked with reflectors so that the position of each reflector can be measured with the robotic total station 600. The reflectors can be disposable reflective sheet targets or prisms. The disposable reflective sheet targets are rather cheap and can be left on the target once the measurement has been done. The prisms are on the other hand expensive and cannot be left on the target after the measurement has been done.

Each door opening DO1-DO4 in the elevator shaft 20 is marked with downwards facing door reflectors DR1*a*-DR4*a*, DR1*b*-DR4*b* positioned at opposite sides of the door opening DO1-DO4. The door reflectors DR1*a*-DR4*a*, DR1*b*-DR4*b* can be mounted e.g. on L-shaped support brackets of thin aluminium that are attached to the wall of the elevator shaft 20. Each door reflector DR1*a*-DR4*a*, DR1*b*-DR4*b* must be facing downwards in the elevator shaft 20.

A robotic total station 600 is installed at a bottom 12 of the elevator shaft 20 and a reference coordinate system K0 of the elevator shaft 20 is created with the robotic total station 600. This can be done so that reflectors are positioned on different positions on the walls of the elevator shaft 20. The origin of the reference coordinate system K0 and the zero position of the horizontal angle i.e. the orientation of the X-axis are first defined with the robotic total station 600. The position of each of the reflectors on the walls of the elevator shaft 20 is then measured with the robotic total station 600. The position of the walls of the elevator shaft 20 are then determined with the robotic total station 600. The reflectors are left on the walls of the elevator shaft 20. The robotic total station 600 can be removed from the elevator shaft 20 and put again back in the elevator shaft 20 at any time. The robotic total station 600 can determine its own position in the reference coordinate system K0 in the elevator shaft 20 based on the position of the reflectors on the walls of the elevator shaft 20. If the coordinates of at least two points in the elevator shaft 20 are already known, then these points could be used to initially orientate the robotic total station 600.

The position of each of the door reflectors DR1*a*-DR4*a*, DR1*b*-DR4*b* is measured with the robotic total station 600. The robotic total station 600 is directed to each door reflector DR1*a*-DR4*a*, DR1*b*-DR4*b* one at a time in order to perform the measurement. The robotic total station 600 is positioned in the same position in the elevator shaft 20 during the measurement. There must be full visibility from the robotic total station 600 to each of the door reflectors DR1*a*-DR4*a*, DR1*b*-DR4*b*. Straight door lines DL1, DL2 are then fitted to the measurements. These vertical straight door lines DL1, DL2 are used as virtual plumb lines for the installation of the doors in the elevator shaft 20.

The position of each guide rail 51, 52, 53, 54 is marked by points A2, B2 on the bottom 12 of the elevator shaft 20 in the coordinate system K0 of the elevator shaft 20. A vector passing between the points A2, B2 specifies the orientation of the guide rails 51, 52, 53, 54 i.e. the rotation of the guide rails 51, 52, 53, 54 around the Z-axis. These points A2, B2 are the target points for the automatic installation of the guide rails 51, 52, 53, 54 in the coordinate system K0 of the elevator shaft 20. The position is selected based on drawings showing the position of the guide rails 51, 52, 53, 54 within a horizontal cross section of the elevator shaft 20.

The lowermost guide rails 51, 52, 53, 54 are mounted manually to the elevator shaft 20 based on the points A2, B2.

Guide rail lines GL1, GL2 can be formed with the robotic total station 600 for the guide rails 51, 52, 53, 54 in the elevator shaft 20. These guide rail lines GL1, GL2 are formed based on the door lines DL1, DL2. These vertical straight guide rail lines GL1, GL2 are used as virtual plumbing lines for the guide rails 51, 52, 53, 54.

An upwards and downwards along the car guide rails 51, 52 movable installation platform 500 is provided in the elevator shaft 20. The installation platform 500 is provided with downwards facing platform reflectors PR1-PR3 on a bottom surface of the installation platform 500. The height position and the orientation of the installation platform 500 in relation to the reference coordinate system K0 is measured with the robotic total station 600 based on the position of the platform reflectors PR1-PR3 in relation to the elevator shaft 20. The platform reflectors PR1-PR3 can originally be positioned e.g. on a common horizontal plane on the bottom surface of the installation platform 500. The orientation of the installation platform 500 in relation to the vertical direction can be calculated based on the difference in the vertical height of the platform reflectors PR1-PR3. The position of the installation platform 500 in the second direction S2 and in the third direction S3 can be calculated based on the differences in the position of the platform reflectors PR1-PR3 in the horizontal direction in relation to the original position of the platform reflectors PR1-PR3.

Different kinds of automated or partly automated installation equipment e.g. industry robots can be positioned on the installation platform 500. The installation equipment can perform e.g. the following tasks: drilling holes to the walls of the elevator shaft 20, attaching brackets to the holes, handling guide rails, joining guide rails to each other, attaching guide rails to the brackets, releasing and tightening bolts in the brackets, adjusting guide rails. There is an internal coordinate system K1 on the installation platform 500. This means that the position of the installation equipment and the working tools of said equipment can be determined at each moment in relation to the installation platform 500. The position of the installation equipment and the working tools of said equipment can thereby also be determined in relation to the elevator shaft 20 as the position and the orientation of the installation platform 500 in relation to the elevator shaft 20 is known. The equipment could be stationary attached to the installation platform 500. The position of the equipment could in such case be determined based on the position of the installation platform 500. The equipment could on the other hand be movable attached to the installation platform 500. The position of the equipment on the installation platform 500 must in such case be measured i.e. there must be a sensor system continuously measuring the position of the movable equipment on the installation platform 500.

A central computer 800 may be used to control and monitor the robotic total station 600 and/or the installation platform 500 and/or the installation equipment on the installation platform 500.

Top reflectors A1, B1 could further be installed on the top 13 of the elevator shaft 20. These top reflectors A1, B1 would be positioned on a vertical straight line above the bottom reflectors A2, B2 positioned at the bottom 12 of the elevator shaft 20. Each top reflector A1, B1 is positioned on a common vertical straight line with the corresponding bottom reflector A2, B2 when the elevator shaft 20 is in an unbent state. The top reflectors A1, B1 will deviate from the common vertical straight line when the elevator shaft 20 bends due to e.g. heavy wind acting on the building. A predetermined bending curve can be fitted between the bottom reflectors A2, B2 and the top reflectors A2, B2 in order to correct the measurement values of the position of the installation platform 500 when the elevator shaft 20 is in a bended state. The top reflectors A1, B1 can be used only in case there is straight visibility from the robotic total station 600 to the top reflectors A1, B1. The installation platform 500 will in most cases restrict the visibility from the robotic total station 600 to the top reflectors A1, B1. The movements of the elevator shaft 20 can, nevertheless, be taken into account by measuring the position of the door reflectors DR1*a*-DR4*a*, DR1*b*, DR4*b*. E.g. when the installation has proceeded to a level above reflector DR4*a*, it would be possible to measure the position of reflectors DR4*a*, DR4*b* and to compare this measurement result with previous measurement results in order to determine the possible change in the position of the reflectors DR4*a*, DR4*b*. This change in position would correlate with a movement of the elevator shaft 20. This makes it possible to determine the movement and twist of the elevator shaft 20 at each different height position during the mounting of the equipment in the elevator shaft 20.

The figure shows further a third door line DL0, which is a vertical centre line of the doors in the elevator shaft 20. The centre door line DL0 is not necessary needed, but it provides an additional virtual plumb line for the doors in the elevator shaft 20. The figure shows also three platform reflectors PR1-PR3. The platform reflector PR3 on the centre door line DL0 is not necessary needed. By using three platform reflectors PR1-PR3 it is possible to determine the position and the orientation of the installation platform 500 in the coordinate system K0 of the elevator shaft 20.

Figure 4:
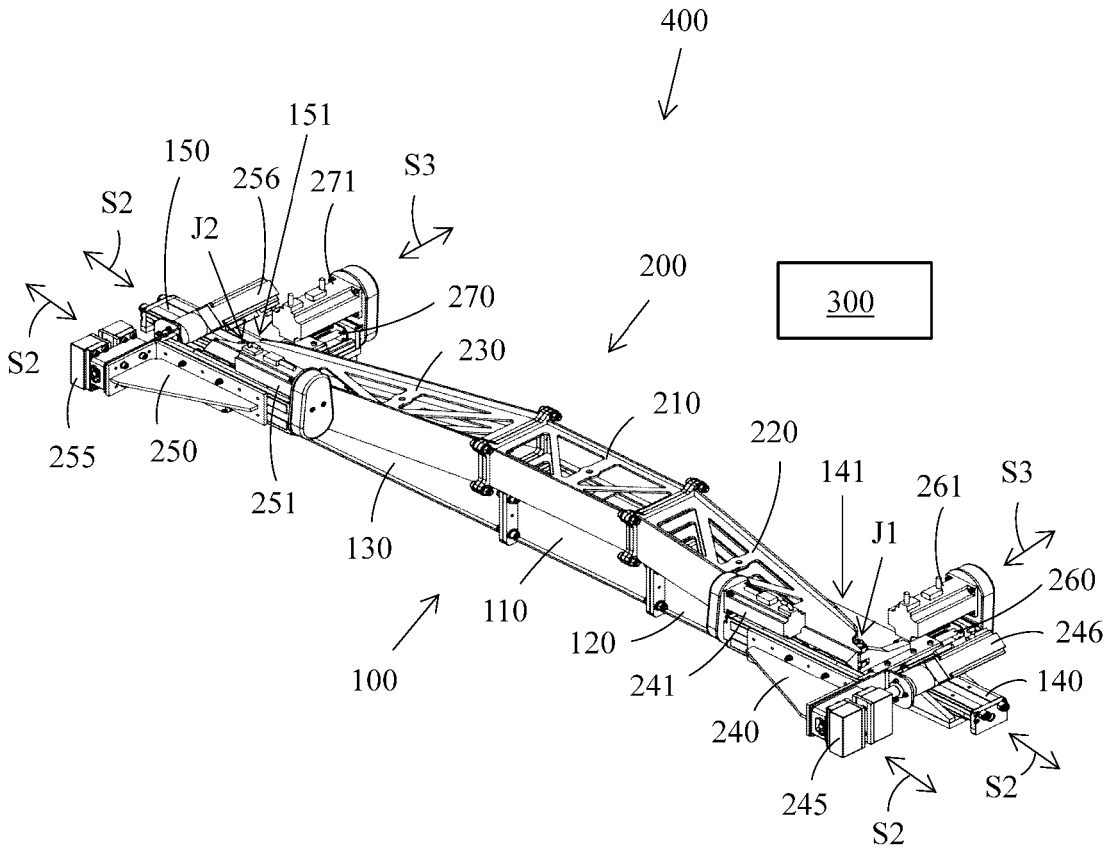
FIG. 4 shows an axonometric view of an apparatus for aligning guide rails in an elevator shaft.

FIG. 4 shows an axonometric view of an apparatus for aligning guide rails in an elevator shaft. The apparatus 400 for aligning guide rails 50 comprises a positioning unit 100 and an alignment unit 200. The apparatus 400 can be used by a mechanic or automatically on the installation platform 500 in order to align guide rails 51, 52, 53, 54.

The positioning unit 100 comprises a longitudinal support structure with a middle portion 110 and two opposite end portions 120, 130. The two opposite end portions 120, 130 are mirror images of each other. There could be several middle portions 110 of different lengths in order to adjust the length of the positioning unit 100 to different elevator shafts 20. The positioning unit 100 comprises further first attachment means 140, 150 at both ends of the positioning unit 100. The first attachment means 140, 150 are movable in the second direction S2 i.e. the direction between the guide rails (DBG). The positioning unit 100 extends across the elevator shaft 20 in the second direction S2. The first attachment means 140, 150 are used to lock the positioning unit 100 between the wall structures 21 and/or dividing beams and/or brackets 60 in the elevator shaft 20. An actuator 141, 151 (position shown only schematically in the figure) e.g. a linear motor in connection with each of the first attachment means 140, 150 can be used to move each of the first attachment means 140, 150 individually in the second direction S2.

The alignment unit 200 comprises a longitudinal support structure with a middle portion 210 and two opposite end portions 220, 230. The two opposite end portions 220, 230 are mirror images of each other. There could be several middle portions 210 of different lengths in order to adjust the length of the alignment unit 200 to different elevator shafts 20. The alignment unit comprises further second attachment means 240, 250 at both ends of the alignment unit 200. The second attachment means 240, 250 are movable in the second direction S2. An actuator 241, 251 e.g. a linear motor can be used to move each of the second attachment means 240, 250 individually in the second direction S2. Each of the second attachment means 240, 250 comprises further gripping means in the form of jaws 245, 255 positioned at the end of the second attachment means 240, 250. The jaws 245, 255 are movable in the third direction S3 perpendicular to the second direction S2. The jaws 245, 255 will thus grip on the opposite side surfaces of the guide rails 50. An actuator 246, 256 e.g. a linear motor can be used to move each of the jaws 245, 255 individually in the third direction S3. The alignment unit 200 is attached to the positioning unit 100 at each end of the positioning unit 100 with support parts 260, 270. The support parts 260, 270 are movable in the third direction S3 in relation to the positioning unit 100. The alignment unit 200 is attached with articulated joints J1, J2 to the support parts 260, 270. An actuator 261, 271 e.g. a linear motor can be used to move each of the support parts 260, 270 individually in the third direction S3. The articulated joints J1, J2 make it possible to adjust the alignment unit 200 so that it is non-parallel to the positioning unit 100.

The two second attachment means 240, 250 are moved with the actuators 241, 251 only in the second direction S2. It would, however, be possible to add a further actuator to one of the second attachment means 240, 250 in order to be able to turn said second attachment means 240, 250 in the horizontal plane around an articulated joint. It seems that such a possibility is not needed, but such a possibility could be added to the apparatus 500 if needed.

The apparatus 400 can be operated by a mechanic or automatically by means of a control unit 300. The control unit 300 can be attached to the apparatus 400 or it can be a separate entity that is connectable with a cable to the apparatus 400. There can naturally also be a wireless communication between the control unit 300 and the apparatus 400. The control unit 300 is used to control all the actuators 141, 142 moving the first attachment means 140, 150, the actuators 241, 242 moving the second attachment means 240, 250, the actuators 246, 256 moving the gripping means 245, 255 and the actuators 261, 271 moving the support parts 260, 270.

Figure 5:
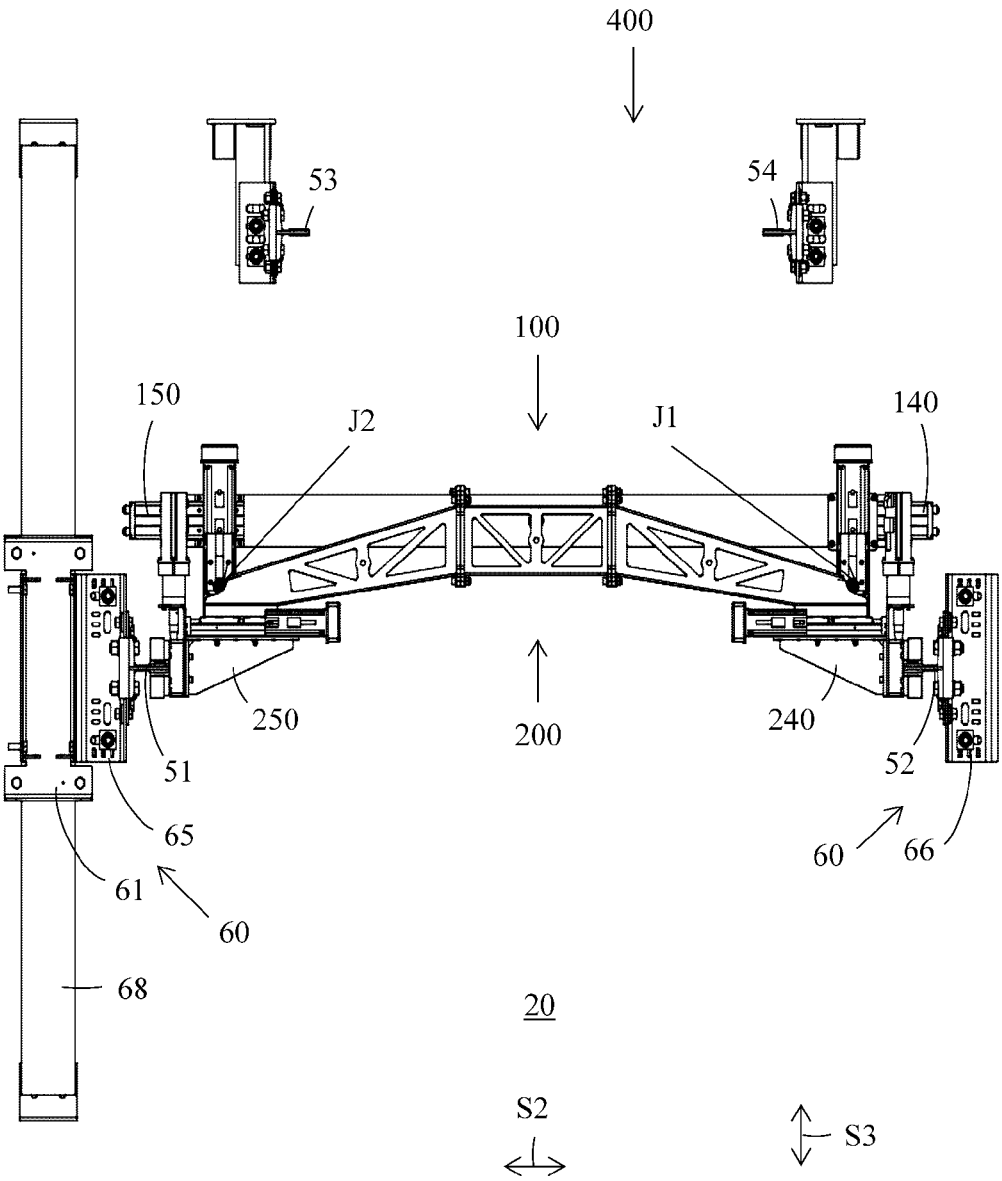
FIG. 5 shows a first phase of the operation of the apparatus of FIG. 4.

FIG. 5 shows a first phase of the operation of the apparatus of FIG. 4. The guide rails 51, 52 are attached to brackets 65, 66 and the brackets 65, 66 can be attached directly to the side wall 21C of the elevator shaft 20 or through a support bar 68 extending between the back wall 21B and the front wall 21A of the elevator shaft 20. The bracket 65 is attached to a bar bracket 61 and the bar bracket 61 is attached to the support bar 68. The apparatus 400 can be supported on an installation platform and lifted with the installation platform to a height location of the first fastening means 60 during the alignment of the guide rails 50. A mechanic may be travelling on the installation platform. The apparatus 400 may be operated by a mechanic or automatically be means of the control unit 300 so that the alignment unit 200 is controlled to attach with the jaws 245, 255 at the ends of the second attachment means 240, 250 to the two opposite guide rails 51, 52. The second attachment means 240, 250 are movable in the second direction S2 and the jaws 245, 255 are movable in the third direction S3 so that they can grip on the opposite vertical side surfaces of the guide rails 51, 52. The bolts of the fastening means 60 are then opened at both sides of the elevator shaft 20 so that the guide rails 51, 52 can be moved. The guide rails 51, 52 on opposite sides of the elevator shaft 20 are then adjusted relative to each other with the alignment unit 200. The frame of the alignment unit 200 is stiff so that the two opposite guide rails 51, 52 will be positioned with the apexes facing towards each other when the gripping means 245, 255 grips the guide rails 50. There is thus no twist between the opposite guide rails 50 after this. The distance between the two opposite guide rails 50 in the direction (DBG) is also adjusted with the alignment unit 200. The position of each of the second attachment means 240, 250 in the second direction S2 determines said distance.

There is a virtual plumb line GL1, GL2 (shown in FIG. 3) formed by the robotic total station 600 in the vicinity of each guide rail 51, 52. The distance in the DBG and the BTF direction from the guide rails 51, 52 to the respective plumb line GL1, GL2 that is in the vicinity of said guide rail 51, 52 is then determined. The needed control values (DBG, BTF and twist) for the apparatus 400 are then calculated. The control values are then transformed into incremental steps, which are fed as control signals to the control units of the linear motors in the apparatus 400. The DBG can also be measured based on the motor torque, which indicates when the second attachment means 240, 250 have reached their end position and are positioned against the guide rails 50. The position of the linear motors can then be read from the display of the control unit 300. The apparatus 400 can thus calculate the DBG based on the distance of the guide rails 51, 52 to the plumb lines and based on the position of each of the second attachment means 240, 250 in the second direction S2.

Figure 6:
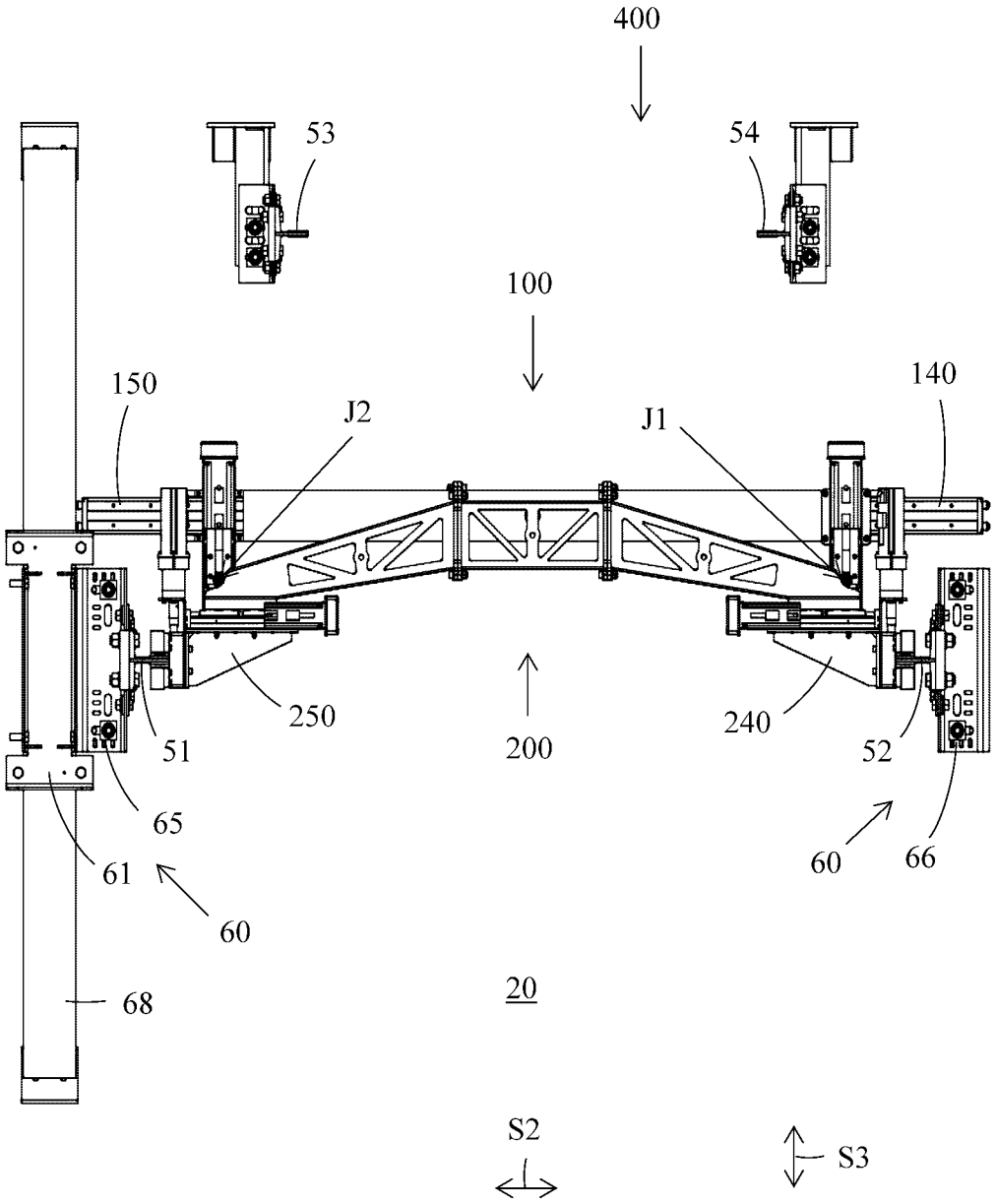
FIG. 6 shows a second phase of the operation of the apparatus of FIG. 4.

FIG. 6 shows a second phase of the operation of the apparatus of FIG. 4. The positioning unit 100 of the apparatus 400 is locked to the wall constructions 21 or other support structures in the elevator shaft 20 with the first attachment means 140, 150. The alignment unit 200 of the apparatus 400 is in a floating mode in relation to the positioning unit 100 when the positioning unit 100 is locked to the wall construction 21 of the elevator shaft 20. The guide rails 51, 52 can now be adjusted with the alignment unit 200 and the positioning unit 100 in relation to the elevator shaft 20. The bolts of the fastening means 60 are then tightened. The apparatus 400 can now be transported to the next location of the fastening means 60 where the first phase and the second phase of the operation of the apparatus 400 is repeated.

Figure 7:
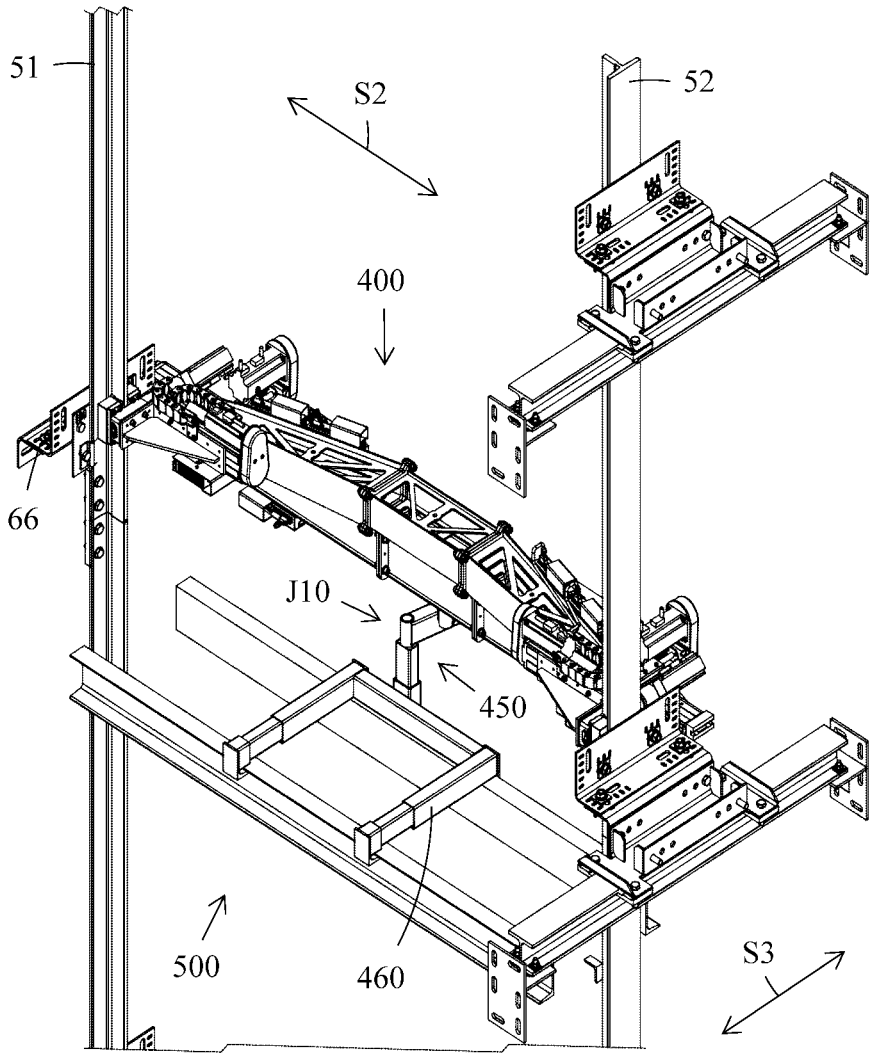
FIG. 7 shows an axonometric view of an elevator shaft with the apparatus of FIG. 4 on an installation platform.

FIG. 7 shows an axonometric view of an elevator shaft with the apparatus of FIG. 4 on an installation platform. The figure shows the car guide rails 51, 52, the installation platform 500 and the apparatus 400 for aligning the guide rails 51, 52. The apparatus 400 for aligning the guide rails 51, 52 is attached with a support arm 450 to a support frame 460 and the support frame 460 is attached to the installation platform 500. The apparatus 400 for aligning the guide rails 51, 52 has to be movable in the second direction S2 and in the third direction S3 in relation to the installation platform 500. This can be achieved with one or several joints J10 in the support arm 450. The support frame 460 can also be arranged to be movable in the second direction S2 and in the third direction S3. The position of the support arm 450 on the installation platform 500 can be measured by sensors arranged in connection with the support frame 460 and/or the support arm 450.

Figure 8:
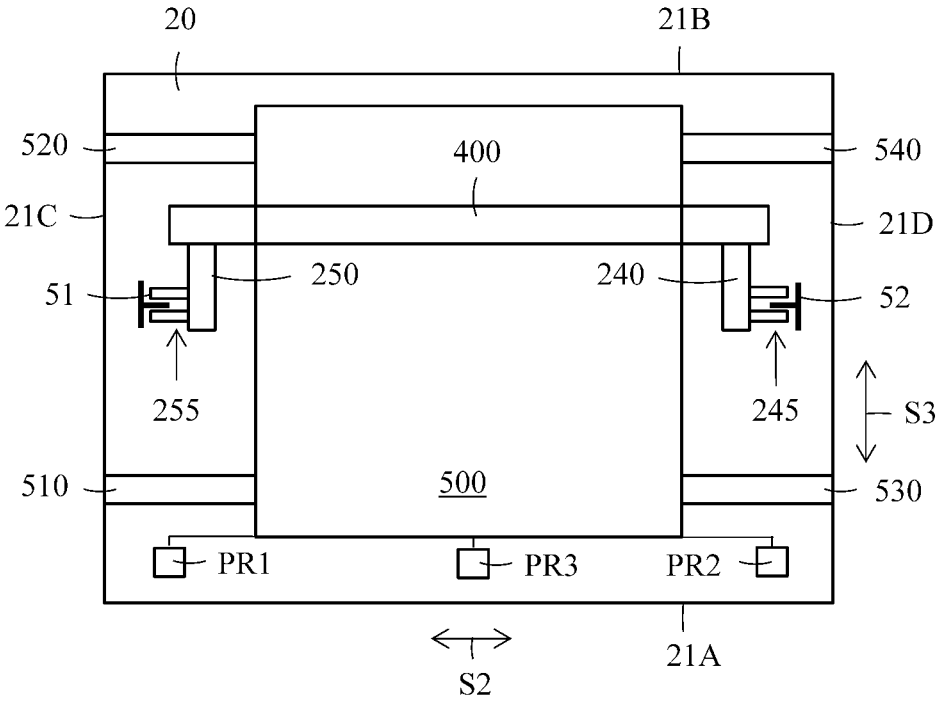
FIG. 8 shows a horizontal cross section of the elevator shaft with the apparatus of FIG. 4 on an installation platform.

FIG. 8 shows a horizontal cross section of the elevator shaft with the apparatus of FIG. 4 on an installation platform. The figure shows the installation platform 500, the apparatus 400 for aligning guide rails and three platform reflectors PR1, PR2, PR3 supported on a bottom of the installation platform 500. The installation platform 500 comprises support arms 510, 520, 530, 540 arranged on opposite sides of the installation platform 500 and being movable in a second direction S2 for supporting the installation platform 500 on the opposite side walls 21C, 21D of the elevator shaft 20. The gripping means 245, 255 of the second attachment means 240, 250 can grip the opposite guide surfaces of the car guide rails 51, 52. The car guide rails 51, 52 can thus be aligned with the apparatus 400 for alignment of guide rails as described earlier in connection with FIGS. 4-6. The installation platform 500 is locked in place with the support arms 510, 520, 530, 540. The position of the installation platform 500 in relation to the elevator shaft 20 is determined with the robotic total station 600 positioned at the bottom 12 of the elevator shaft 20 based on the position of the platform reflectors PR1-PR3 once the installation platform 500 is locked in the elevator shaft 20. When the coordinates of the stationary installation platform 500 in relation to the elevator shaft 20 are determined, then it is possible to determine the coordinates of the alignment apparatus 400 in relation to the installation platform 500 continuously during the alignment procedure. The alignment apparatus 400 is movably attached to the installation platform 500, whereby the position of the alignment apparatus 400 in relation to the elevator shaft 20 can be determined indirectly based on the position of the installation platform 500 in relation to the elevator shaft 20. The position of the alignment apparatus 400 on the installation platform 500 can be measured with sensors measuring the position of the support frame 460 and/or the support arm 450. The position of the guide rails 51, 52 can be determined indirectly based on the position of the apparatus 400. The alignment apparatus 400 could on the other hand be stationary attached to the installation platform 500. The position of the alignment apparatus 400 would in such case remain stationary on the installation platform 500. The position of the gripping means 245, 255 could then be determined in relation to the stationary attachment point of the alignment apparatus 400 on the installation platform 500.

The installation platform 500 may be provided with different installation equipment in addition to the apparatus 400 for aligning guide rails. The installation equipment may be used to install doors and guide rails. The installation equipment may comprise one or several robots being stationary or movable on the installation platform 500. The installation platform 500 may be supported with gliding means on the opposite car guide rails 51, 52 during the movement in the first direction S1 upwards and downwards in the elevator shaft 20. A hoist may be used to move the installation platform 500 in the first direction S1 upwards and downwards in the elevator shaft 20.

The position of the first guide rails 51, 52, 53, 54 at the bottom 12 of the elevator shaft 20 are marked on the bottom 12 of the elevator shaft based on the dimensions of the elevator shaft 20, the elevator car 10 and the counter weight 42. The first car guide rails 51, 52, 53, 54 at the bottom 12 of the elevator shaft 20 are thereafter installed manually to the elevator shaft 20.

The installation platform 500 can then be installed to the elevator shaft 20 so that the installation platform 500 glides on the car guide rails 51, 52 when the hoist moves the installation platform 500 upwards and downwards in the elevator shaft 20. The doors and the further guide rails 51, 52, 53, 54 can thereafter be installed into the elevator shaft 20 with the installation platform 500. The alignment of the guide rails 51, 52, 53, 54 can be done as a separate process after the guide rails 51, 52, 53, 54 have been erected.

The aligning of guide rails 51, 52, 53, 54 has been described in connection with the car guide rails 51, 52, but the same aligning procedure can naturally also be applied when aligning counter weight guide rails 52, 53.

The transfer of information and control data between the robotic total station 600 and the control unit 300 and the computer 800 may be by wireless communication or by wire. The transfer of information and control data between the installation platform 500 and the control unit 300 and between the apparatus for alignment 400 and the control unit 300 may be by wireless communication or by wire.

The robotic total station 600 should be capable of a long range if it is used in a high-rise building. A robotic total station 600 is a general purpose 3D positioning device commonly used in civil engineering and industrial measurements. A robotic total station is a device measuring positions of points in relation to the device in polar coordinates. The device operates in a polar coordinate system, but the results are calculated by standard trigonometry into a right-angled X-, Y-, Z-coordinate system. The robotic total station measures the horizontal angle, the vertical angle and the distance (slope distance) to the target. Encoders are used for measuring the horizontal angle and the vertical angle and a laser based distance sensor is used for measuring the distance. A robotic total station gives the X-, Y- and Z-coordinates of the target to be measured. The target to be measured is marked either with a prism or with a reflective sheet target that can be attached with an adhesive. The results of the measurements are added to the position of the robotic position, which has been determined in an initial orientation of the robotic total station. The initial orientation of the robotic total station means that the robotic total station is set to be ready to perform measurements. If there are reference points with known coordinates in the environment of the robotic total station, then two or more of these reference points are pointed out to the robotic total station. The robotic total station can based on the coordinates of these reference points determine its own position in said coordinate system.

A robotic total station can be operated by a computer i.e. the device can be remote driven by a computer. The robotic total station comprises thus servo motors by means of which the robotic total station can be directed towards the targets to be measured. Robotic total stations are manufactured e.g. by Leica Geosystems, Sokkia, Trimble and Topcon. Leica TS30 has been tested in an elevator shaft and it seems to work well also in vertical measurements.

The robotic total station 600 could be operated manually by a mechanic at the bottom 12 of the elevator shaft 20. The aiming of the robotic total station 600 can be done by a red laser dot and a telescope of the robotic total station. An additional eyepiece is used to be able to do the measurements in an upwards direction.

The robotic total station 600 could also be operated automatically with the aid of a remotely located computer. There could be a wireless connection or a connection by wire between the robotic total station 600 and the computer. The coarse position of the reflectors in the elevator shaft 20 are known, which means that it is possible to instruct the robotic total station 600 to aim at a given direction and to find the reflector in said direction.

The use of virtual plumb lines is advantageous compared to the use of mechanical plumb lines. Mechanical plumb lines are formed by wires, which start to vibrate immediately when they are touched by accident. The measurements have to be interrupted until the wire stops vibrating.

The arrangement and the method can be used in elevator installations where the hoisting height in the elevator shaft is over 30 mm, preferably 30-80 meters, most preferably 40-80 meters.

The arrangement and the method can on the other hand also be used in elevator installations where the hoisting height in the elevator shaft is over 75 meters, preferably over 100 meters, more preferably over 150 meters, most preferably over 250 meters.

The installation platform 500 can be used to install car guide rails 51, 52 and/or counter weight guide rails 53, 54.

The use of the invention is not limited to the type of elevator disclosed in the figures. The invention can be used in any type of elevator e.g. also in elevators lacking a machine room and/or a counterweight. The counterweight is in the figures positioned on the back wall of the elevator shaft. The counterweight could be positioned on either side wall of the elevator shaft or on both side walls of the elevator shaft. The lifting machinery is in the figures positioned in a machine room at the top of the elevator shaft. The lifting machinery could be positioned at the bottom of the elevator shaft or at some point within the elevator shaft.

It will be obvious to a person skilled in the art that, as the technology advances, the inventive concept can be implemented in various ways. The invention and its embodiments are not limited to the examples described above but may vary within the scope of the claims.

The invention claimed is:

1. An arrangement for automatic elevator installation, comprising:

downwards facing door reflectors, each door opening in an elevator shaft being marked with the downwards facing door reflectors positioned at opposite sides of the door opening;

a robotic total station positioned at a bottom of the elevator shaft, whereby a reference coordinate system of the elevator shaft is created with the robotic total station, the position of the door reflectors in relation to the elevator shaft being measured with the robotic total station such that measurements thereof are provided; and straight door lines fitted to the measurements, said straight door lines forming virtual plumb lines for doors in the elevator shaft;

wherein predetermined positions of the guide rails on the bottom of the elevator shaft are marked based on dimensions of the elevator shaft and an elevator car, wherein lowermost guide rails are installed manually to the elevator shaft based on the predetermined positions of the guide rails, wherein vertical guide rail lines are formed with the robotic total station based on the door lines, said vertical guide rail lines forming virtual plumb lines for the guide rails in the elevator shaft, wherein an upwards and downwards movable installation platform is provided in the elevator shaft, wherein downwards facing platform reflectors are positioned on a bottom of the installation platform, and wherein a position of the platform reflectors is measured in relation to the elevator shaft with the robotic total station, whereby an orientation and the position of the installation platform in relation to the elevator shaft is determined.

2. A method for automatic elevator installation, said method comprising the step of using the arrangement according to claim 1.

3. A method for automatic elevator installation, comprising the steps of:

marking each door opening in an elevator shaft with downwards facing door reflectors positioned at opposite sides of the door opening;

positioning a robotic total station at a bottom of the elevator shaft and creating a reference coordinate system of the elevator shaft with the robotic total station;

measuring the position of the door reflectors in relation to the elevator shaft with the robotic total station and providing measurements thereof;

fitting straight door lines to the measurements, said straight door lines forming virtual plumb lines for doors in the elevator shaft;

marking predetermined positions of guide rails on the bottom of the elevator shaft based on dimensions of the elevator shaft and an elevator car;

installing a lowermost of the guide rails manually to the elevator shaft based on the predetermined positions of the guide rail;

forming vertical guide rail lines with the robotic total station based on the door lines, said vertical guide rail lines forming virtual plumb lines for the guide rails in the elevator shaft;

providing an upwards and downwards movable installation platform in the elevator shaft;

positioning downwards facing platform reflectors on a bottom of the installation platform; and measuring a position of the platform reflectors in relation to the elevator shaft with the robotic total station, whereby an orientation and the position of the installation platform in relation to the elevator shaft is determined.

4. The method according to claim 3, further comprising the step of providing support arms on opposite sides of the installation platform, said support arms being movable outwardly from the installation platform in order to support the installation platform on opposite side walls of the elevator shaft.

5. The method according to claim 4, further comprising the step of providing an apparatus for aligning guide rails on the installation platform, said apparatus comprising:

a positioning unit extending horizontally across the elevator shaft in a second direction and comprising a first attachment mechanism movable in the second direction at each end of the positioning unit for supporting the positioning unit on opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the elevator shaft, said second attachment mechanism comprising grippers configured to grip on the guide rail.

6. The method according to claim 4, further comprising the step of providing downwards facing top reflectors at a top of the elevator shaft, whereby the measurements of the robotic total station are corrected based on movement of the top reflectors corresponding to bending of the elevator shaft caused by wind during the measurements.

7. The method according to claim 4, further comprising the step of aligning guide rails by an apparatus for aligning guide rails positioned on the installation platform.

8. The method according to claim 3, further comprising the step of providing an apparatus for aligning guide rails on the installation platform, said apparatus comprising:

a positioning unit extending horizontally across the elevator shaft in a second direction and comprising a first attachment mechanism movable in the second direction at each end of the positioning unit for supporting the positioning unit on opposite wall structures of the elevator shaft; and an alignment unit extending across the elevator shaft in the second direction and being supported with support parts on each end portion of the positioning unit so that each end portion of the alignment unit is individually movable in relation to the positioning unit in a third direction perpendicular to the second direction, and comprising a second attachment mechanism movable in the second direction at each end of the alignment unit for supporting the alignment unit on opposite guide rails in the elevator shaft, said second attachment mechanism comprising grippers configured to grip on the guide rail.

9. The method according to claim 8, further comprising the step of providing downwards facing top reflectors at a top of the elevator shaft, whereby the measurements of the robotic total station are corrected based on movement of the top reflectors corresponding to bending of the elevator shaft caused by wind during the measurements.

10. The method according to claim 8, further comprising the step of aligning guide rails by an apparatus for aligning guide rails positioned on the installation platform.

11. The method according to claim 3, further comprising the step of providing downwards facing top reflectors at a top of the elevator shaft, whereby the measurements of the robotic total station are corrected based on movement of the top reflectors corresponding to bending of the elevator shaft caused by wind during the measurements.

12. The method according to claim 11, further comprising the step of aligning guide rails by an apparatus for aligning guide rails positioned on the installation platform.

13. The method according to claim 3, further comprising the step of aligning guide rails by an apparatus for aligning guide rails positioned on the installation platform.

14. The method according to claim 13, further comprising the step of arranging a control unit for controlling the apparatus for aligning guide rails.

15. The method according to claim 14, further comprising the step of connecting the robotic total station and the control unit in order to be able to at least one of transfer measurement and control signals between the robotic total station and the control unit.

* * * * *